US006032314A

United States Patent [19]

Bowd

[11] Patent Number: 6,032,314

[45] Date of Patent: Mar. 7, 2000

[54] GLASS CLEANER

[75] Inventor: Denise Bowd, Barnsley, United Kingdom

[73] Assignee: D & B Products Ltd, South Yorkshire, United Kingdom

[21] Appl. No.: 09/035,644

[22] Filed: Mar. 5, 1998

[51] Int. Cl.[7] ..... A47L 17/00

[52] U.S. Cl. ..... 15/104.92; 15/211; 15/244.4

[58] Field of Search ..... 15/104.92, 211, 15/212, 213, 244.1, 244.4

[56] References Cited

U.S. PATENT DOCUMENTS

| | | | |
|---|---|---|---|
| 1,936,259 | 11/1933 | Parmer | 15/211 |
| 3,135,003 | 6/1964 | Wise | 15/211 |
| 3,161,903 | 12/1964 | Worthington | 15/244.1 |
| 3,750,219 | 8/1973 | MacConnell . | |
| 3,913,165 | 10/1975 | Behnk . | |
| 4,111,666 | 9/1978 | Kalbow | 15/244.4 |
| 4,802,927 | 2/1989 | Barbour . | |
| 5,687,444 | 11/1997 | Hakker | 15/104.92 |
| 5,727,275 | 3/1998 | Rocha | 15/211 |

FOREIGN PATENT DOCUMENTS

| | | |
|---|---|---|
| 27 30 266 | 1/1979 | Germany . |
| 1 518 269 | 7/1978 | United Kingdom . |

*Primary Examiner*—Terrence R. Till
*Attorney, Agent, or Firm*—Adams law Firm, P.A.

[57] ABSTRACT

A cleaning arrangement intended especially for cleaning drinks glasses includes an open-topped cylindrical container (11) in which is mounted a foamed plastics material cleaning member (18) which has protrusions (24) from its upper face between which an upturned drinks glass may be wiped.

7 Claims, 2 Drawing Sheets

GLASS CLEANER

The present invention concerns cleaning arrangements, especially but not exclusively arrangements for cleaning the rims of drinking glasses.

A problem encountered in bars and restaurants is the removal of lipstick deposits from the rims of drinking glasses during the cleaning of these glasses.

Glasses are normally washed in an automatic washing and drying apparatus which has a relatively quick cycling time. Whereas the apparatus efficiently removes drinks residues, finger prints etc. from the glasses, it is found in practice that it often fails to remove lipstick deposits from the rim of the glasses.

Lipstick is a relatively greasy and consequently waterproof substance and is difficult to remove merely by the action of hot, detergent carrying water flowing over it, this action being the action of the dish washing apparatus. Additionally, lipstick is usually highly coloured so that even minimal residual traces are highly visible.

The presence of a drink in a lipstick stained glass is not attractive to the customer and has a detrimental effect on the suppliers business and reputation.

SUMMARY OF THE INVENTION

According to the present invention there is provided a cleaning arrangement having an open topped container, an absorbent resilient cleaning member of a foamed material within the container, the upper face of said member having upward protrusions therefrom and the member being impregnable or impregnated with a cleaning fluid so that an article to be cleaned can be moved between said protrusions which, due to their rubbing action against the article and the action of the cleaning fluid clean that part of the article passing therebetween.

Preferably the member is a foamed plastics material.

Preferably the protrusions in the upper face of the member are provided by forming downwardly directed incisions through the upper region of the member above said top surface.

Alternatively, the protrusions may be provided by moulding dimples, teeth, columns or other extensions from the upper face.

Preferably the open topped container is cylindrical and has an inwardly directed flange around its upper rim. The flange may be downwardly directed.

Preferably the foamed member is cylindrical having an external diameter which is approximately equal to the internal diameter of the container.

Preferably the container has anti-friction or other fixing means on its base.

Preferably the container is formed by a suitable moulding process from a plastics material. Preferably the material is acrylonitrile-butadiene-styrene ("ABS").

Preferably the foam member is impregnated with an anti-bacterial cleaning concentrate.

BRIEF DESCRIPTION OF THE DRAWINGS

An embodiment of the present invention will now be described by way of example only with reference to the accompanying drawings in which.

DESCRIPTION OF THE PREFERRED EMBODIMENT AND BEST MODE

Figure 1:
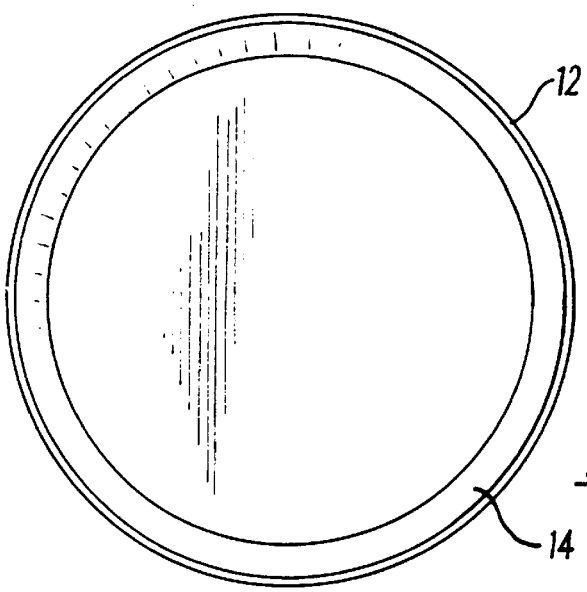
FIG. 1 is a top plan view of the container of a cleaning arrangement.
Figure 2:
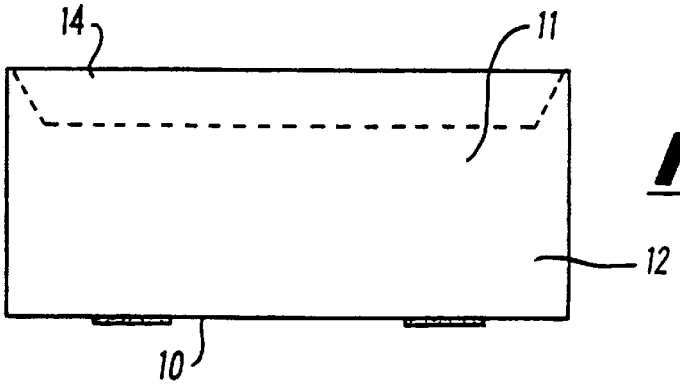
FIG. 2 is a side elevation.
Figure 3:
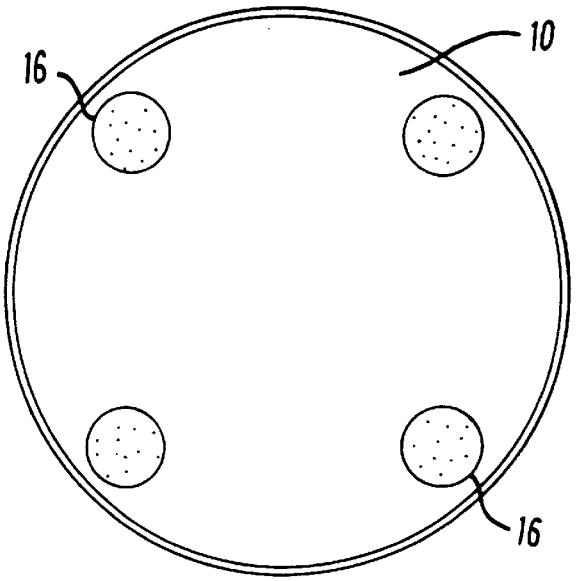
FIG. 3 is a view from below.
Figure 4:
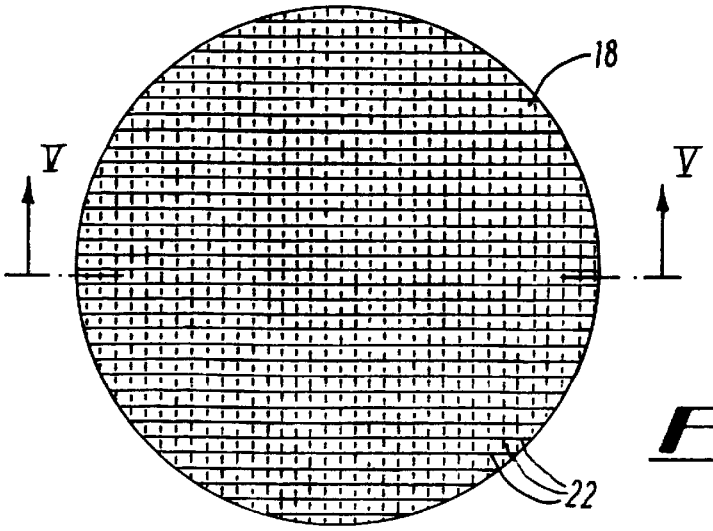
FIG. 4 is a view from above of a cleaning member of the cleaning arrangement.
Figure 5:
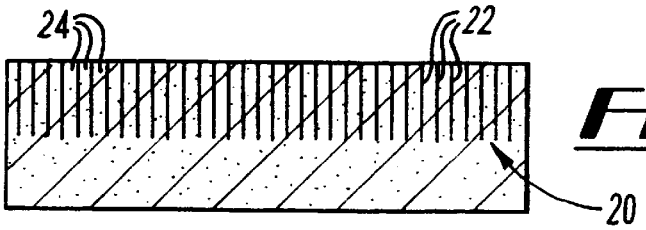
FIG. 5 is a sectional elevation of said cleaning member taken along the line V—V of FIG. 4.
Figure 6:
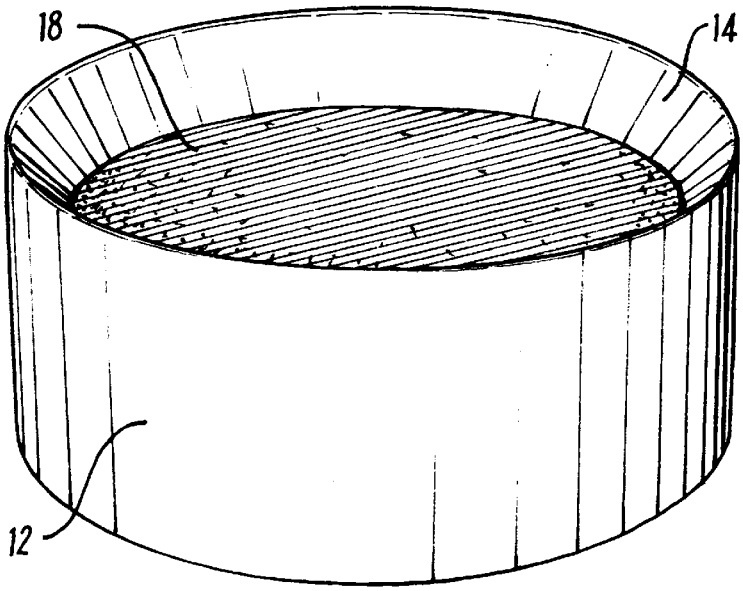
FIG. 6 shows a various perspective view of the cleaning arrangement.

A cleaning arrangement is intended principally for cleaning the rims of drinking glasses prior to the complete cleaning of said glasses in an automatic or manual washing process. It comprises a moulded cylindrical open-topped plastics container 11 having a base 10, an upstanding wall 12 and an inwardly and downwardly directed upper flange 14. The diameter of the opening to the container is such that it can receive the downwardly directed open top of any of one the range of glasses normally used in public houses, restaurants, cafes etc.

The base 10 of the container has four anti-friction pads 16 attached thereto so that when torque is applied to the container during a glass cleaning operation it remains fixed against rotation on the surface on which it is placed.

The container includes a cleaning member 18 of foamed plastics material which is cylindrical in shape, having an external diameter substantially equal to the internal diameter of the container such that the member can be placed within the container by deforming it so that it passes through the flange 14 and is thereafter maintained in the container by the overhanging flange. The foam member 18 has a plurality of virtually perpendicular cuts 22 formed therein extending down to the unbroken top surface 20 of the member. It is impregnated with a cleaning fluid which can take any suitable composition and should contain material capable of dissolving and/or reacting with the potentially waterproof material contained in lipsticks whereby any lipstick coming into contact with the material is softened or otherwise reacted with to facilitate its removal from the article.

Suitable cleaning fluids are HYDROCLENS and CONQUEST (Trade Marks). This or any other suitable anti-bacterial cleaning concentrate may be employed.

It is intended that the foam member is fitted to the container at the point of use and then impregnated with the cleaning fluid. It is packed in a moisture-proof container. At the point of use, for example, beside a washing bowl or glass washing apparatus, after unpacking, assembly and impregnation, the cleaning apparatus can be placed on a surface so that any empty used glasses, especially those seen to have lipstick, lip balm or grease stains on their rim, can be inverted and in the inverted orientation inserted through the open top of the container into the cleaning member, the rim of the glass pushing aside the member such that the rim penetrates into the incisions 22. Those parts 24 of the member protruding upwardly from its top surface 20 rub against the internal and external surfaces of the glass rim and the abrasive action between the glass and the cleaning member assists in the removal of lipstick and any other stains. Removal of the lipstick material is enhanced by rotating the glass relative to the cleaning member. When the rim cleaning operation has been concluded the glass can be removed and thereafter completely washed by any normal washing or cleaning operation.

Various modifications can be made without departing from the scope of the invention, for example, the protrusions from the top surface of the member can be formed by dimples, teeth, columns or any other projections moulded into the member during the manufacturing process.

The container can have any suitable shape and it may have surface decoration, in the form, for example, of advertising or promotional material. Three rubber feet replace the four anti-friction pads.

What is claimed is:

1. A cleaning arrangement having an open topped container, an absorbent resilient cleaning member of a foamed plastics material within the container, an upper face of said member having upward protrusions therefrom provided by forming downwardly directed incisions through an upper region of the member and the member being impregnable with a cleaning medium so that an article to be cleaned can be moved between said protrusions which, due to their rubbing action against the article and the action of the cleaning medium, clean that part of the article passing therebetween.

2. An arrangement as claimed in claim 1, wherein the container has anti-friction means on its base.

3. An arrangement as claimed in claim 1, wherein the container is formed by a moulding process from a plastics material.

4. An arrangement as claimed in claim 3, wherein the plastics material is acrylonitrile-butadiene-styrene.

5. An arrangement as claimed in claim 1, wherein the foam member is impregnated with an anti-bacterial cleaning concentrate.

6. A cleaning arrangement having an open topped cylindrical container with an inwardly and downwardly directed flange around an upper rim of said container, an absorbent resilient cleaning member of a foam plastics material within said container, an upper face of said member having upward protrusions therefrom provided by forming downwardly directed incisions through the upper region of the member and the member being impregnable with a cleaning medium so that an article to be cleaned can be moved between said protrusions which, due to their rubbing action against the article and the action of the cleaning medium, clean that part of the article passing therebetween.

7. A cleaning arrangement having a cylindrical open topped container, an absorbent resilient cylindrical cleaning member of a foamed plastics material positioned within said container and having an external diameter which is approximately equal to an internal diameter of the container, an upper face of said member having upward protrusions therefrom provided by forming downwardly directed incisions through an upper region of the member and the member being impregnable with a cleaning medium, so that an article to be cleaned can be moved between said protrusions which, due to their rubbing action against the article and the action of the cleaning medium, clean that part of the article passing therebetween.

* * * * *